US012624614B2

(12) United States Patent
Hanson et al.

(10) Patent No.: US 12,624,614 B2
(45) **Date of Patent: *May 12, 2026**

(54) REMOTELY ACTIVATED MULTI-CYCLE WELLBORE CLEANING TOOL

(71) Applicant: Halliburton Energy Services, Inc., Houston, TX (US)

(72) Inventors: Jon-Howard Elliott Hanson, Dallas, TX (US); Kyle Wayne Davis, Celina, TX (US); Peter Reid Maher, Lafayette, LA (US); Timothy Simmonds, Highlands Ranch, CO (US); Alan Pace, Inverbervie (GB); Gavin Munro, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/063,696

(22) Filed: Feb. 26, 2025

(65) Prior Publication Data

US 2025/0198257 A1 Jun. 19, 2025

Related U.S. Application Data

(62) Division of application No. 17/443,089, filed on Jul. 20, 2021, now Pat. No. 12,258,841.

(51) Int. Cl.
*E21B 37/02* (2006.01)

(52) U.S. Cl.
CPC ..... *E21B 37/02* (2013.01)

(58) Field of Classification Search
CPC ..... E21B 23/006; E21B 37/02
See application file for complete search history.

(56) References Cited

U.S. PATENT DOCUMENTS 2,679,905 A 6/1954 Mangum et al.
4,625,799 A 12/1986 Mccormick et al.
(Continued)

FOREIGN PATENT DOCUMENTS

EP 2321492 7/2020
GB 2621084 1/2024
(Continued)

OTHER PUBLICATIONS

"PCT Application No. PCT/US2021/070928, International Preliminary Report on Patentability", Feb. 1, 2024, 7 pages.
(Continued)

*Primary Examiner* — Tara Schimpf
*Assistant Examiner* — Lamia Quaim
(74) *Attorney, Agent, or Firm* — DeLizio, Peacock, Lewin & Guerra LLP

(57) ABSTRACT

A downhole tool for cleaning a wellbore, the tool including a tool body having a flowpath therethrough. A liquid is configured to flow through the flowpath and may have an intermittent flow pattern. An inner sleeve positioned within the tool body includes a recess having a recess pattern. In response to the intermittent flow pattern, a shift pin positioned in the recess of the inner sleeve traverses through the recess pattern. The downhole tool includes at least one scraper blade. The scraper blade is movable between a retracted position and a radially expanded position. In response to the shift pin traversing the recess pattern of the recess, the scraper blade can be expanded radially outward toward a wall of the wellbore from the retracted position to the expanded position and/or retracted inward away from the wall of the wellbore from the expanded position to the retracted position.

15 Claims, 10 Drawing Sheets

(56) References Cited

U.S. PATENT DOCUMENTS

| | | | | |
|---|---|---|---|---|
| 5,074,355 | A | 12/1991 | Lennon | |
| 6,152,221 | A | 11/2000 | Carmichael et al. | |
| 10,190,376 | B2 | 1/2019 | Machocki | |
| 10,526,871 | B2 | 1/2020 | Tzallas et al. | |
| 2009/0025927 | A1* | 1/2009 | Telfer | E21B 37/04 166/174 |
| 2014/0262211 | A1 | 9/2014 | Xu et al. | |
| 2020/0080400 | A1 | 3/2020 | Garcia | |
| 2023/0021731 | A1 | 1/2023 | Hanson et al. | |

FOREIGN PATENT DOCUMENTS

| | | |
|---|---|---|
| ID | P00202313555 | 12/2023 |
| WO | 2016172323 | 10/2016 |
| WO | 2023003591 | 1/2023 |

OTHER PUBLICATIONS

"PCT Application No. PCT/US2021/070928, International Search Report and Written Opinion", Apr. 18, 2022, 10 pages.
"U.S. Appl. No. 17/443,089, Final Office Action", Dec. 12, 2023, 15 pages.
"U.S. Appl. No. 17/443,089, Final Office Action", Apr. 25, 2023, 12 pages.
"U.S. Appl. No. 17/443,089, Non-Final Office Action", Feb. 27, 2024, 14 pages.
"U.S. Appl. No. 17/443,089, Non-Final Office Action", Jul. 17, 2023, 16 pages.
"U.S. Appl. No. 17/443,089, Restriction Requirement", Jul. 20, 2022, 7 pages.
"U.S. Appl. No. 17/443,089 Non Final Office Action", Sep. 1, 2022, 12 pages.

* cited by examiner

6/10

REMOTELY ACTIVATED MULTI-CYCLE WELLBORE CLEANING TOOL

CLAIM OF PRIORITY

This application is a divisional application of U.S. application Ser. No. 17/443,089, filed on Jul. 20, 2021, the entire contents of which are incorporated herein by reference.

TECHNICAL FIELD

The disclosure generally relates to wellbore completions and, more particularly, to downhole tools for performing wellbore cleanout operations.

BACKGROUND

In completed wellbores, debris from drilling, completion, and/or production operations can be removed using downhole tools having deployable scrapers. Generally, cleaning tools are included as part of a wellbore cleaning system and are run into the wellbore with scraper blades retracted. Once positioned in the wellbore, the scraper blades of the cleaning tool can be deployed to be in contact with an interior of a casing of the wellbore and, as the cleaning tool is pulled out of hole, the scraper cleaning blades mechanically clean the interior of the casing.

BRIEF DESCRIPTION OF THE DRAWINGS

Embodiments of the disclosure may be better understood by referencing the accompanying drawings.

DETAILED DESCRIPTION

Figure 1:
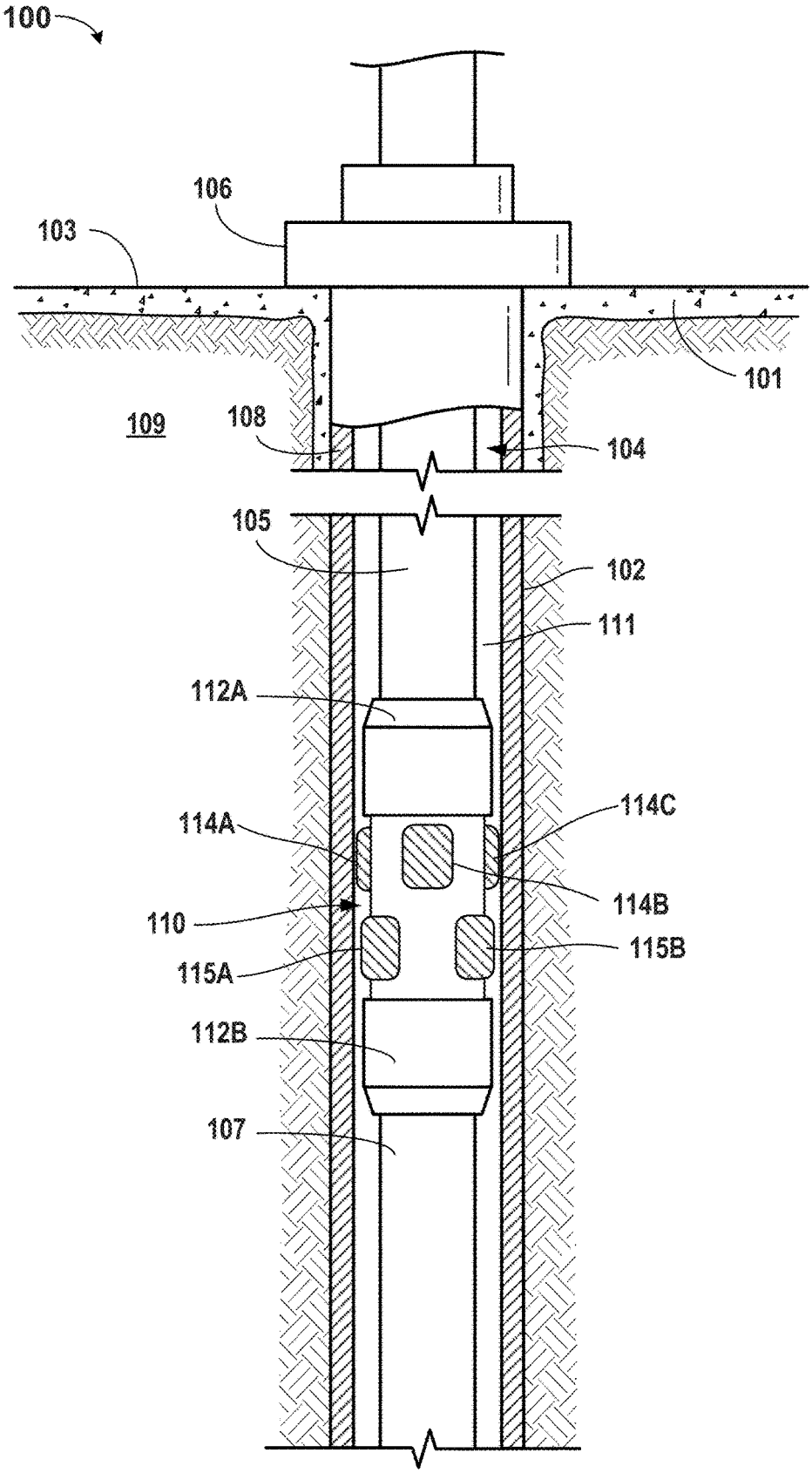
FIG. 1 depicts a partial cross-sectional view of an example wellbore system, according to some embodiments.

The description that follows includes example systems, methods, techniques, and program flows that embody embodiments of the disclosure. However, it is understood that this disclosure may be practiced without these specific details. For instance, this disclosure refers to cleaning an interior of a casing of a wellbore in illustrative examples. Embodiments of this disclosure can also be applied to cleaning of production tubing disposed within a cased wellbore. In other instances, well-known instruction instances, protocols, structures and techniques have not been shown in detail in order not to obfuscate the description.

When performing wellbore cleanout operations, it is common to run in cleaning tools downhole in a trip separate from other steps of the cleanout operation because, with conventional cleaning tools, deployment of scraper blades and/or cleaning brushes or blades of the tool can include shearing devices, causing the tool to be a single-use tool. In addition to extending the time required to perform wellbore cleaning operations, conventional downhole cleaning tools can be limited to a single activation cycle and may require multiple downhole trips and multiple cleaning tools if more than one scraping operation is required. Further, conventional downhole cleaning tools can require dropping of a ball, dart, etc. from a surface of the wellbore through an interior passage of the cleaning tool in order to deploy the scraper blades/brushes of the tool, preventing the passage of additional downhole tools and/or a flow of fluid to or from the surface through the interior of the cleaning tool.

In contrast to conventional cleaning tools, example embodiments do not require shearing of inner components to deploy the scraper blades, allowing for multiple deployment cycles in a single run. Once a cleaning operation is completed, the scraper blades can be retracted to reduce the likelihood of wear to the scraper blades and/or the casing as the cleaning tool is pulled out of hole.

Example embodiments of a downhole cleaning tool can include remotely deployable and retractable scraper blades, allowing the cleaning tool to be multi-use. Further, deployment and retraction of the scraper blades can be performed without restricting and/or blocking an interior passage of the cleaning tool. For example, example embodiments can include a slidable inner mandrel movable between a first and second position, where moving the inner mandrel from the first position to the second position deploys the scraper blades of the cleaning tool.

In some embodiments, one or more magnets can be disposed in an exterior recess of the inner mandrel and on an interior face of the scraper blades. When the tool is inactivated, the magnets of the inner mandrel and the magnets of the scraper blades can be offset, and the scraper blades can be substantially flush with an external surface of the cleaning tool. In some embodiments, the inner mandrel can be a material that attracts the magnets of the scraper blades. For example, when the magnets of the scraper blades are offset from the magnets of the inner mandrel, the scraper blades can be retracted as the magnets of the scraper blades pull the scraper blades radially inward toward the inner mandrel. When the cleaning tool is activated, movement of the inner mandrel can align the magnets of the inner mandrel with the magnets of the scraper blades and deploy the scraper blades radially outward from the tool body as the magnets repel one another.

In some embodiments, the cleaning tool can be activated by a flow of a fluid through an inner passage of a workstring including the cleaning tool. The flow of fluid can reduce a pressure differential between the inner passage of the workstring and an annulus of the wellbore defined between the workstring and the casing. In some embodiments, the decreased pressure differential can enable axial movement of a piston of the cleaning tool and movement of the piston can axially shift the inner mandrel towards an activated configuration.

The flow of fluid can cause a portion of the cleaning tool to engage with a recess in a lower sleeve of the tool, moving the cleaning tool from the inactivated configuration (where the scraper blades are retracted) to the activated configuration (where the scraper blades are deployed). In some embodiments, the recess may be a continuous J-slot disposed on an external surface of the lower sleeve, and a pattern of the J-slot can limit downward movement of portions of the cleaning tool to control activation of the cleaning tool.

In some embodiments, flowing fluid for pre-determined time intervals can activate and/or deactivate the cleaning tool. Additionally, the cleaning tool can be activated and deactivated multiple times by starting and/or stopping the flow of fluid. The flowing of fluid for defined time intervals can move a locating pin from an inactivated position in the J-slot recess to an activated position where downward movement of portions of the cleaning tool (for example, the inner mandrel) is unrestricted.

In some embodiments, a first portion of the cleaning tool can include an internal bypass valve to improve fluid circulation when the scraper blades are deployed. Additionally, the internal bypass valve can allow for fluid flow during a scraper operation, better cleaning the scraper blades, the casing, and/or liner tops of the completed wellbore. In some embodiments, the cleaning tool can include a spring that biases the cleaning tool back toward the inactivated position where the scraper blades are retracted and the internal bypass is closed.

Example System

FIG. 1 depicts a partial cross-sectional view of an example wellbore system, according to some embodiments. FIG. 1 depicts an example wellbore system 100. The system 100 includes a wellbore 102 extending through, i.e., formed in, a subterranean formation 109 from a wellhead 106 located at a surface 103 (i.e., the earth's surface). Although not depicted as such, the wellhead 106 could be a subsea wellhead located where the wellbore intersects a sea floor. The wellbore 102 includes a casing 108 (e.g., a casing string). The casing 108 does not necessarily extend the full length of the wellbore 102. In some embodiments, the casing 108 can be at least partially cemented into the subterranean formation, e.g., via one or one or more layers of cement 101. Although the cement 101 is shown near the surface 103, in one or more embodiments cement can extend the length of the wellbore 102. Although the wellbore 102 is depicted as a single vertical wellbore, other implementations are possible. For example, the wellbore 102 can include one or more deviated or horizontal portions. Although only one casing 108 is shown, multiple casing strings may be radially and/or circumferentially disposed around the casing 108.

A workstring 104 can be positioned within the wellbore 102 forming an annulus 111 between the workstring 104 and the casing 108. As depicted in FIG. 1, the workstring 104 includes a cleaning tool 110. In some embodiments, the cleaning tool 110 can join a first section 105 of the workstring 104 with a second section 107 of the workstring 104. In some embodiments, the workstring 104 can include additional downhole tools. For example, the workstring 104 may include one or more measurement tools for formation evaluation. Example measurement tools can include acoustic measurement systems, nuclear magnetic resonance (NMR) systems, various sensors (i.e. temperature, pressure, fluid flow, etc.), or any combination of formation evaluation tools and/or systems known to those skilled in the art. In some embodiments, the workstring 104 may be positioned within the wellbore 102 via a wireline.

In some embodiments, the workstring 104 can include one or more centralizers 112A and 112B coupled to the cleaning tool 110. As depicted in FIG. 1, two centralizers 112A and 112B are coupled to an upper and lower portion of the cleaning tool 110. However, in some embodiments, the workstring 104 may include a greater or lesser number of centralizers. For example, the workstring 104 may include only one centralizer coupled to the cleaning tool 110. Alternatively or in addition, the workstring 104 may include centralizers that are not coupled to the cleaning tool 110 to centralize the workstring 104 within the wellbore 102.

In some embodiments, the cleaning tool 110 can be a scraper tool and include scraper blades 114A, 114B, 114C, 115A, 115B, and 115C (not pictured). Alternatively or in addition, the cleaning tool 110 can include brushes and/or other components to clean an inner surface of the casing 108. FIG. 1 depicts the blades 114A-C and 115A-B in a deployed configuration, where the blades 114A-C and 115 A-B are in contact with the inner surface of the casing 108. However, in some embodiments, the blades 114A-C and 115A-B can be in a retracted or un-activated configuration, where the blades 114A-C and 115A-B are not in contact with the inner surface of the casing 108.

There may be one or more sets of scraper blades. In some implementations, scraper blades of a set may be positioned in substantially equal azimuthal intervals to achieve 360 degree coverage when the blades are deployed. For example, a first scraper blade set having three scraper blades 114A, 114B, and 114C may have 120 degrees between centers of the scraper blades. Optionally, scraper blades can be staggered axially to provide full 360 degree coverage across multiple sets of scraper blades. For example, a second set of scraper blades 115A, 115B, and 115C (not pictured) may also have 120 degree azimuthal spacing, but with a 60 degree offset relative to the first set of scraper blades. Alternatively, scraper blades may be positioned to have unequal spacing. The quantity and positioning of scraper blades as depicted by the figures is non-limiting.

Example Cleaning Tools

Figure 2:
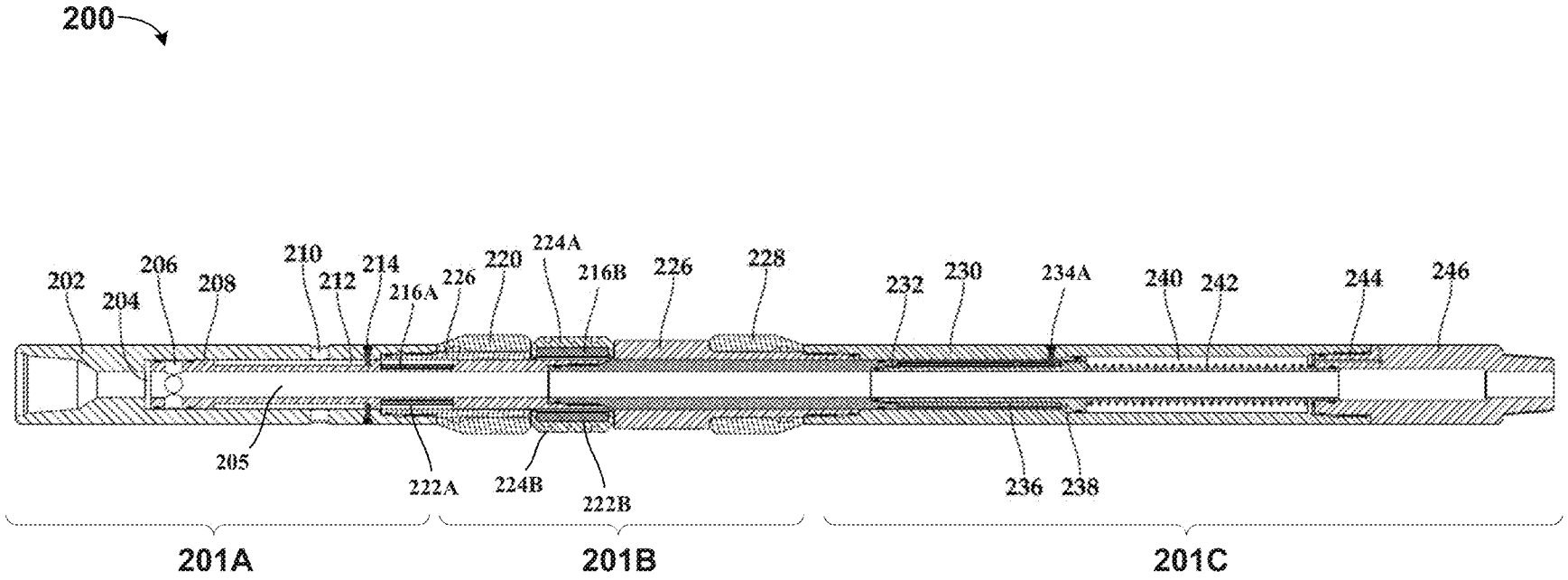
FIG. 2 depicts a cross-sectional view of an example cleaning tool in an inactive configuration, according to some embodiments.

Example embodiments of cleaning tools are now described. FIG. 2 depicts a cross-sectional view of an example cleaning tool in an inactive configuration, according to some embodiments. FIG. 2 depicts an example cleaning tool 200 to be positioned within a wellbore. The cleaning tool 200 can be formed of three portions—an upper portion 201A, a central portion 201B, and a lower portion 201C. The upper portion 201A can include an upper adaptor 202, a piston 204, and an upper inner mandrel 208. The upper inner mandrel 208 can partially extend into the second portion 201B and can fluidly couple the upper portion 201A with the central portion 201B to create an inner passage 205. The central portion 201B can include centralizers 220 and 228, a scraper body 226, scraper blades 224A and 224B positioned about the scraper body 226, and a scraper mandrel 232. The scraper body 226 can couple the upper adaptor 202 with a lower tool body 230 of the lower portion 201C. The lower portion 201C can include a shift pin 234A, a J-slot sleeve 236, a lower inner mandrel 238 coupled to a spring 242 in an oil chamber 248, and a lower adaptor 246. In some embodiments, the scraper mandrel 232 can couple the upper inner mandrel 208 to the lower inner mandrel 238 such that axial translation of the upper inner mandrel 208 axially translates the scraper mandrel 232 and the lower inner mandrel 238 to compress the spring 242. The passage 205 can extend through the scraper mandrel 232 and the lower inner mandrel 238 to allow for fluid flow through the upper portion 201A, the central portion 201B, and the lower portion 201C of the cleaning tool 200.

In some embodiments, the upper adaptor 202 and the lower adaptor 246 can couple the cleaning tool 200 to a workstring. For example, with reference to FIG. 1, the cleaning tool 200 can be coupled to the first section 105 of the workstring 104 via the upper adaptor 202 and the second section 107 of the workstring 104 via the lower adaptor 246. The centralizers 220 and 228 can center the cleaning tool 200 and/or the workstring in the wellbore.

In some embodiments, the cleaning tool 200 can be activated and de-activated from a surface of the wellbore by controlling a flow of fluid through the passage 205 of the cleaning tool 200, as further described below. When activated, the scraper blades 224A and 224B can be radially expanded from the cleaning tool 200 to be in contact with an inner surface of a casing of the wellbore. When inactive, the scraper blades 224A and 224B can be retracted.

The upper inner mandrel 208 can be movable between a first position (i.e., the cleaning tool 200 is inactive and the scraper blades 224A/224B of the cleaning tool 200 are retracted) and a second position (i.e., the cleaning tool 200 is activated and the scraper blades 224A/224B of the cleaning tool 200 are expanded). To help illustrate, FIGS. 3A-3B depict the upper portion 201A in an inactive and activate configuration, respectively.

Figure 3A:
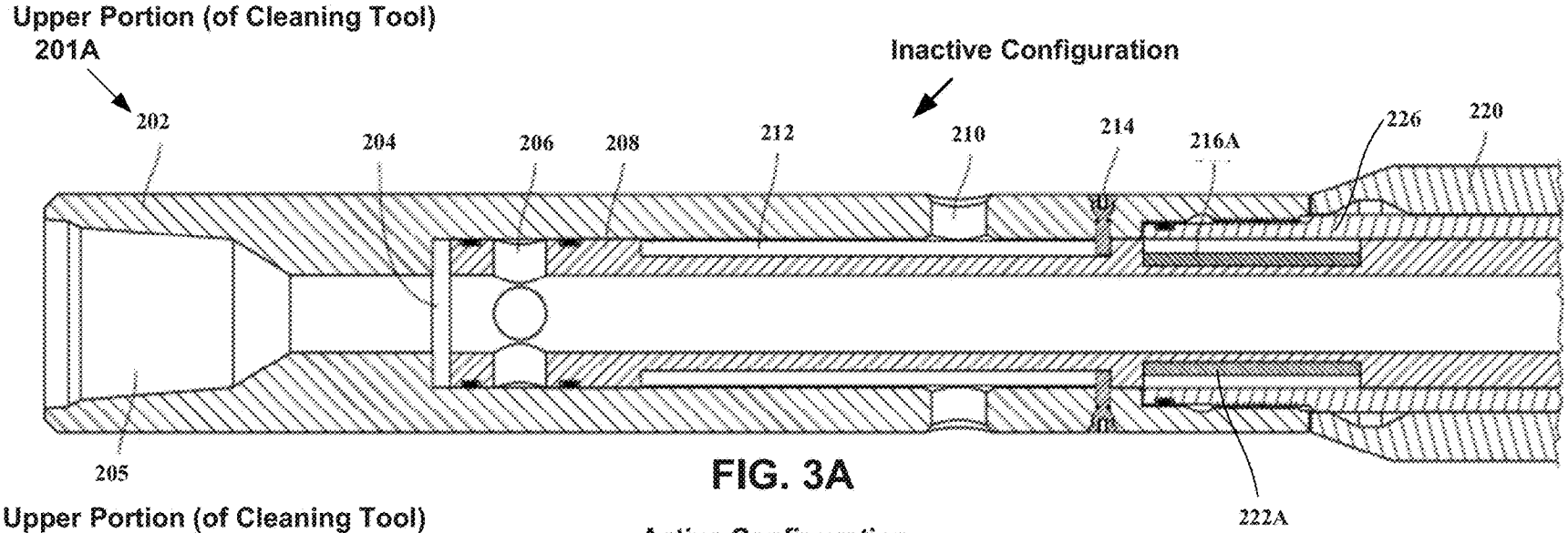
FIGS. 3A-3B depict cross-sectional views of the upper portion of the example cleaning tool of FIG. 2 when the tool is in the inactive configuration and active configuration, respectively, according to some embodiments.
Figure 3B:
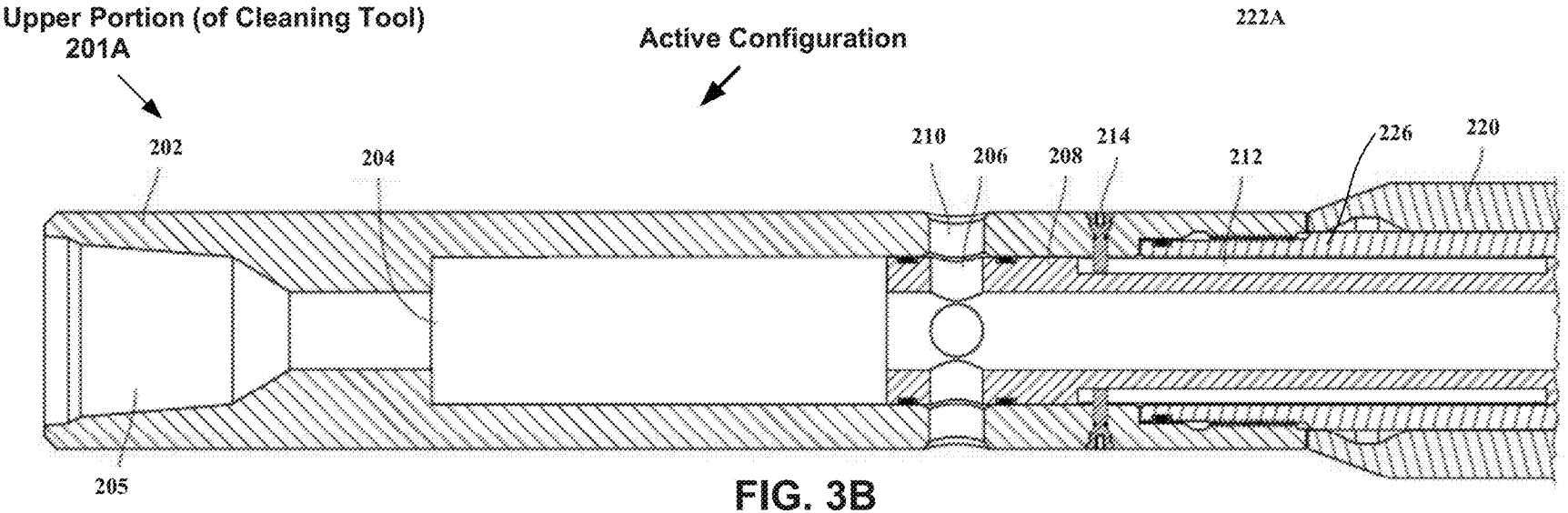

FIGS. 3A-3B depict cross-sectional views of an upper portion of the example cleaning tool of FIG. 2 when the cleaning tool is in an inactive configuration and an active configuration, respectively, according to some embodiments. In particular, FIG. 3A depicts an example of the upper portion 201A of the cleaning tool 200 of FIG. 2 when in an inactive configuration. Alignment pins 214 can extend through a wall of the upper adaptor 202 and extend within a recess 212 in an outer surface of the upper inner mandrel 208. In some embodiments, the upper inner mandrel 208 can include an internal bypass 206. When the upper inner mandrel 208 is in the first position (i.e., the cleaning tool 200 is inactive and the scraper blades 224A/224B of the cleaning tool 200 are retracted), as depicted in FIG. 3A, the internal bypass 206 is closed and fluid flow through the passage 205 is prevented from entering an annulus (the annulus 111, for example) of the wellbore.

Referring to FIG. 3B, an example of the upper portion 201A of the cleaning tool 200 of FIG. 2 is depicted when in an active configuration. When the upper inner mandrel 208 is moved to the second position (i.e., when the cleaning tool 200 is activated and the scraper blades 224 of the cleaning tool 200 are expanded), fluid flow through the passage 205 can enter the wellbore annulus via the internal bypass 206 as the internal bypass 206 aligns with a bypass opening 210 in the upper adaptor 202.

In some embodiments, the upper inner mandrel 208 can be moved to the second position to activate the cleaning tool 200 by controlling the piston 204. For example, the piston 204 may be hydraulically actuated by a flow of fluid from a surface of the wellbore. In some embodiments, the piston 204 may be electrically actuated to move the upper inner mandrel 208 from the first position, as depicted in FIG. 3A, to the second position, as depicted in FIG. 3B. As the upper inner mandrel 208 moves from the first position to the second position, the upper inner mandrel 208 may slide axially. In some embodiments, alignment pins 214 can couple the upper inner mandrel 208 with the upper adaptor 202 to limit movement of the upper inner mandrel 208. For example, the alignment pins 214 may extend from the upper adaptor 202 into a recess 212 in an outer surface of the upper inner mandrel 208 and prevent rotation of the upper inner mandrel 208 with respect to the upper adaptor 202 as well as limit axial translation of the upper inner mandrel 208.

Returning to FIG. 2, in some embodiments, movement of the upper inner mandrel 208 can align a pair of repelling magnets to expand the scraper blades 224A/224B. A magnet 216A can be disposed on an outer surface of the upper inner mandrel 208 and a repelling magnet 216B can be disposed on an inner surface of the scraper blade 224A. A second magnet 222A disposed on the outer surface of the upper inner mandrel 208 can form a repelling pair of magnets with a magnet 222B disposed on an inner surface of the scraper blade 224B. While two pairs of repelling magnets are depicted in FIG. 2, a lesser or greater number of pairs of repelling magnets may be present. For example, each scraper blade may have a magnet that forms a repelling pair with a magnet of the upper inner mandrel 208. Alternatively, only one scraper blade may have a magnet that forms a repelling pair with a magnet of the upper inner mandrel 208.

Figure 4A:
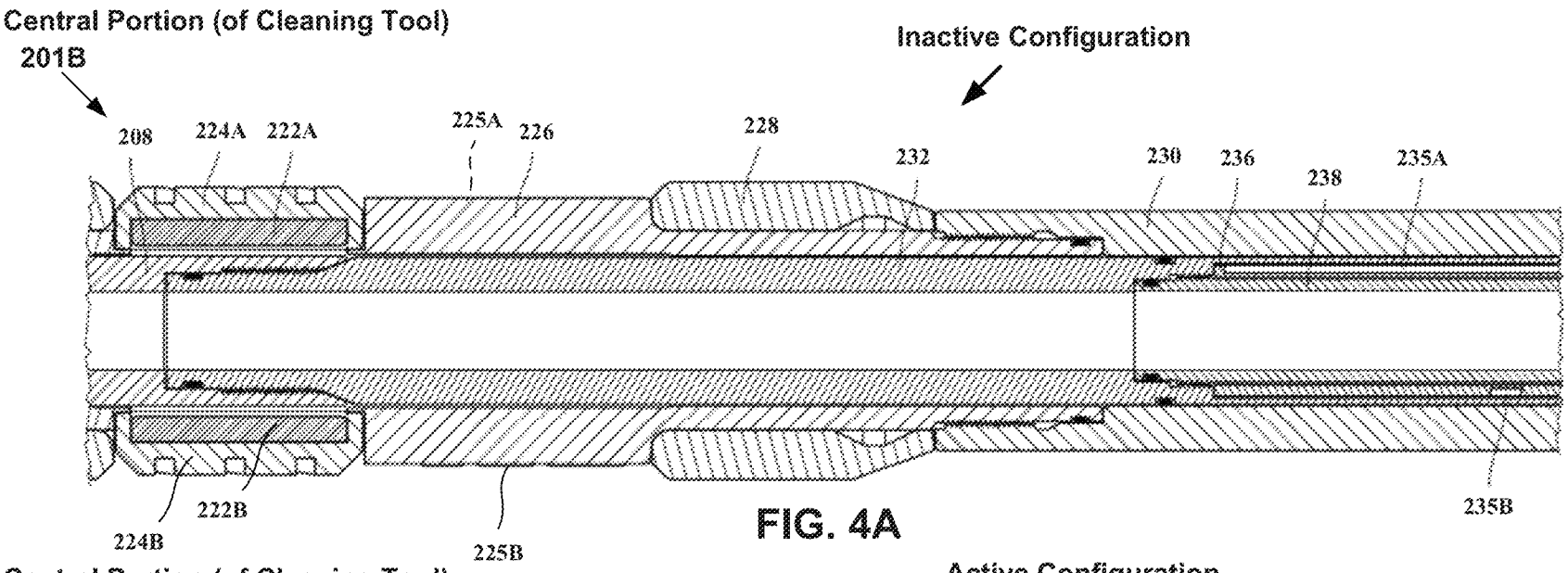
FIGS. 4A-4B depict cross-sectional views of the central portion of the example cleaning tool of FIG. 2 when the tool is in the inactive configuration and active configuration, respectively, according to some embodiments.
Figure 4B:
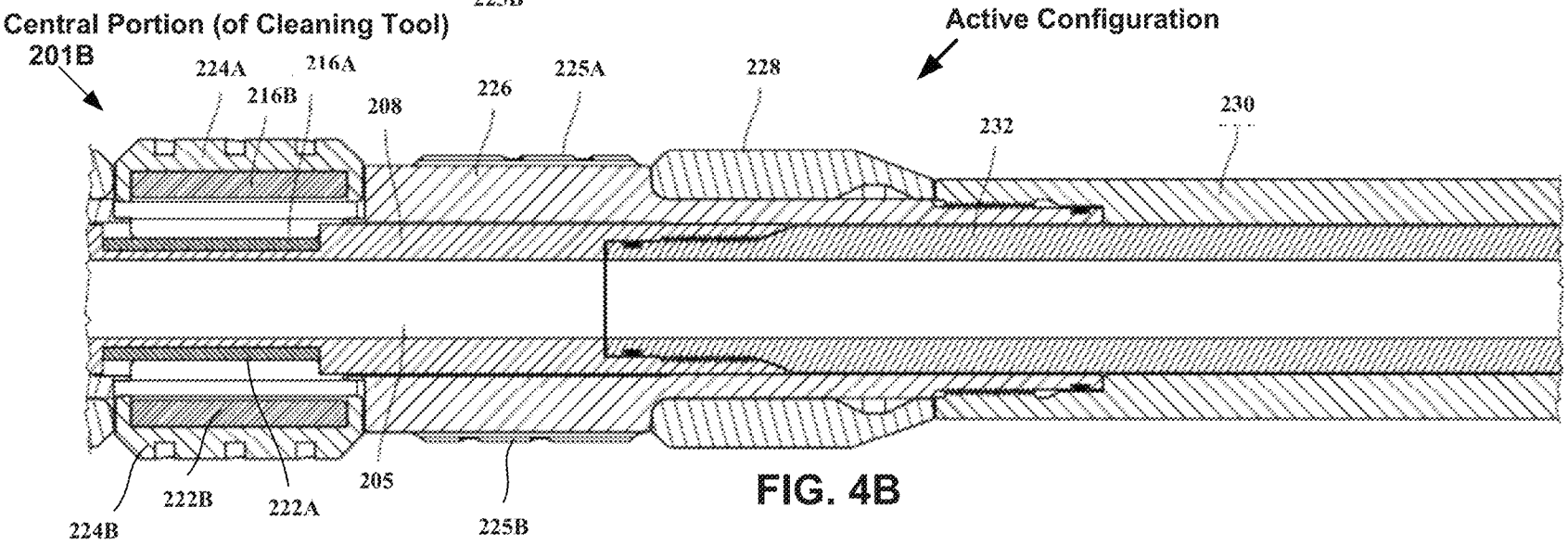

To help illustrate, FIGS. 4A-4B depict cross-sectional views of a central portion of the example cleaning tool of FIG. 2 when the cleaning tool is in the inactive configuration and active configuration, respectively, according to some embodiments. In particular, FIG. 4A depicts an example of the central portion 201B of the cleaning tool 200 of FIG. 2 when in an inactive configuration. When the upper inner mandrel 208 is in the first position (as depicted in FIG. 3A) and the cleaning tool 200 is inactive, the scraper blades 224A/224B are retracted, the magnets 216A and 216B are not aligned, and the magnets 222A and 222B are not aligned. In some embodiments, the cleaning tool 200 may have more than one set of scraper blades. FIG. 4A depicts a second set of scraper blades 225A (not pictured) and 225B in a retracted position. In some embodiments, the upper inner mandrel 208 may be magnetic and the magnets 216B/222B may be attracted to the upper inner mandrel 208, pulling the scraper blades 224A/224B inward when the cleaning tool 200 is inactive. When the upper inner mandrel 208 is moved to the second position (as depicted in FIG. 3B), the magnets 216A and 216B align, the magnets 222A and 222B align, and the magnets 216A and 222A repel the magnets 216B and 222B, respectively, to expand the scraper blades 224A and 224B outward.

Referring to FIG. 4B, an example of the central portion 201B of the cleaning tool 200 of FIG. 2 is depicted when in the active configuration, according to some embodiments. As depicted, the magnets 216A and 216B are aligned and the scraper blades 224A are deployed. In some embodiments, additional sets of scraper blades may be positioned at a second axial location along the cleaning tool 200 and can be deployed similarly. As depicted in FIG. 4B, the additional scraper blades 225A and 225B are also deployed. In some embodiments, sets of scraper blades may be azimuthally offset relative to one another in order to increase a surface area of the scraper blades. To help illustrate, FIG. 5 depicts scraper blades of the cleaning tool 200 in a deployed position.

Figure 5:
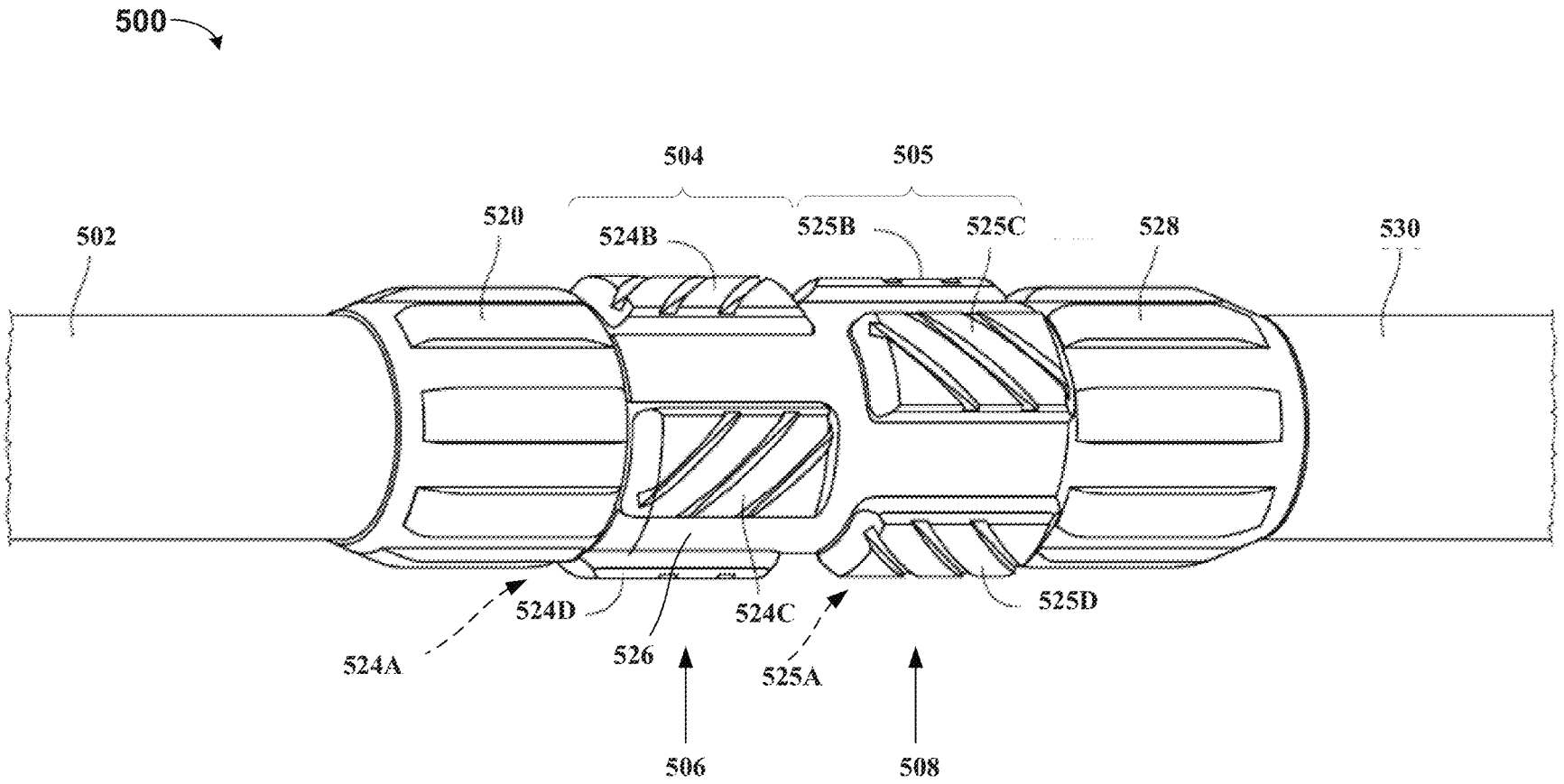
FIG. 5 depicts an isometric view of an example cleaning tool having two sets of scraper blades in the active configuration, according to some embodiments.

FIG. 5 depicts an isometric view of an example cleaning tool having two sets of scraper blades in the deployed configuration, according to some embodiments. As depicted, FIG. 5 depicts an isometric view of an example cleaning tool 500 having two sets of scraper blades. Similar to the example cleaning tool 200, the cleaning tool 500 includes an upper adaptor 502, two centralizers 520 and 528, a scraper body 526, and a lower adaptor 530. The cleaning tool 500 includes a first set of scraper blades 504 positioned at a first axial location 506 along the cleaning tool 500 and a second set of scraper blades 505 positioned at a second axial location 508 along the cleaning tool 500.

FIG. 5 depicts the first set of scraper blades 504 as having four scraper blades 524A (not shown), 524B, 524C, and 524D. In some embodiments, a set of scraper blades may have a greater or lesser number of scraper blades. For example, the cleaning tool 500 can include a set of scraper blades having three scraper blades. As depicted, the scraper blades 524A, 524B, 524C, and 524D circumscribe the scraper body 526 and are positioned to have substantially equal degree phasing between each blade (i.e., 90 degrees) around a central longitudinal axis of the cleaning tool 500. In some embodiments, scraper blades of a set of scraper blades can be positioned to have substantially equal spacing around the central longitudinal axis of the cleaning tool 500. For example, scraper blades of a set of three scraper blades can be positioned at 120 degree intervals around the central longitudinal axis of the cleaning tool 500.

FIG. 5 depicts the second set of scraper blades 505 as having four scraper blades 525A (not pictured), 525B, 525C, and 525D. Similar to the first set of scraper blades 504, the scraper blades 525A, 525B, 525C, and 525D are positioned at 90 degree intervals to circumscribe the scraper body 526. As depicted, the first set of scraper blades 504 can be azimuthally offset relative to the second set of scraper blades 505. For example, FIG. 5 depicts the second set of scraper blades 505 as being offset by approximately 45 degrees relative to the second set of scraper blades 504. In some embodiments, sets of scraper blades can be offset by any degree phasing. Alternatively, sets of scraper blades can be aligned and have a substantially 0 degree offset.

While FIG. 5 depicts the first set of scraper blades 504 and the second set of scraper blades 505 as having an equal number of scraper blades, in some embodiments, sets of scraper blades can have differing quantities of scraper blades. For example, the first set of scraper blades 504 may have three scraper blades while the second set of scraper blades 505 may have four scraper blades. FIG. 5 depicts two sets of scraper blades 504 and 505. In some embodiments, there may be a greater or lesser number of sets of scraper blades. For example, the cleaning tool 500 can have only one set of scraper blades. Alternatively, the cleaning tool 500 can have more than two sets of scraper blades. For example, the cleaning tool 500 can have three or four sets of scraper blades. In some embodiments, the first set of scraper blades 504 and the second set of scraper blades 505 may axially overlap. While FIG. 5 depicts the first set of scraper blades 504 at the first axial location 506 and the second set of scraper blades 505 at the second axial location 508, the first and second axial locations 506 and 508 may vary such that at least a portion of the scraper blades of the first set of scraper blades 504 and a portion of the scraper blades of the second set of scraper blades 505 share an axial location. As noted similarly in reference to FIG. 1, the quantity and positioning of scraper blades as depicted by FIG. 5 is non-limiting.

Returning to FIG. 2, axial translation of the upper inner mandrel 208 can be transmitted to the lower inner mandrel 238 via the scraper mandrel 232. When the cleaning tool 200 is activated, the upper inner mandrel 208, scraper mandrel 232, and lower inner mandrel 238 move rightward and the spring 242 is compressed.

Figure 6A:
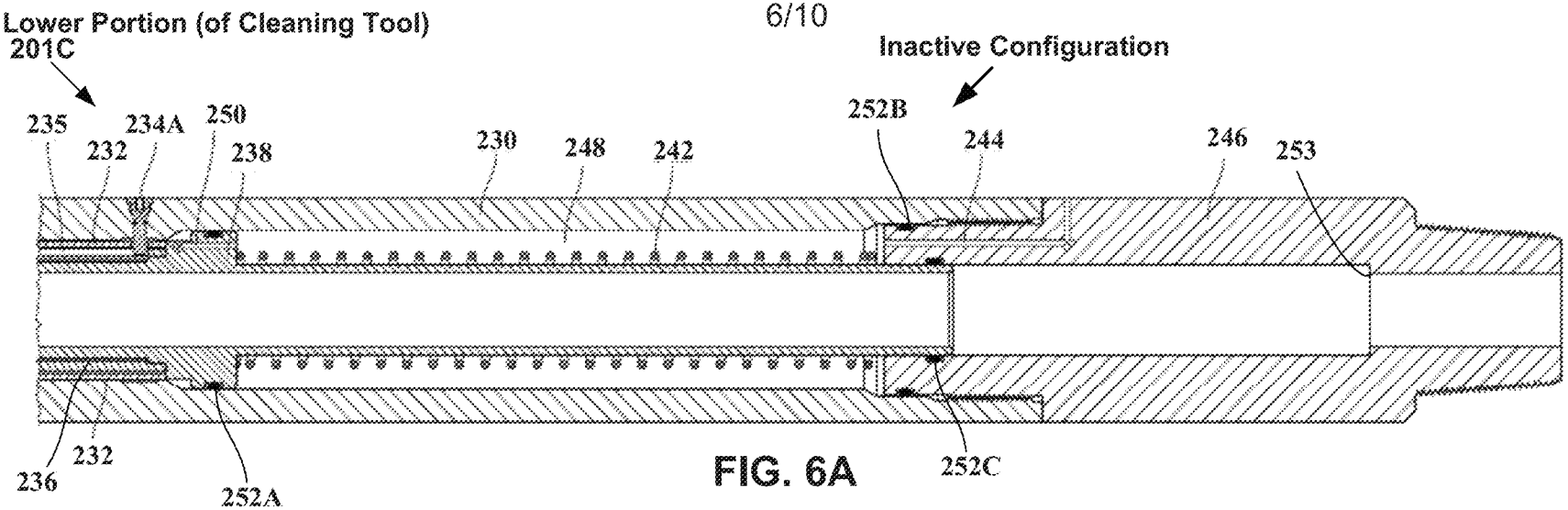
FIGS. 6A-6B depict cross-sectional views of the lower portion of the example cleaning tool of FIG. 2 when the tool is in the inactive configuration and active configuration, respectively, according to some embodiments.
Figure 6B:
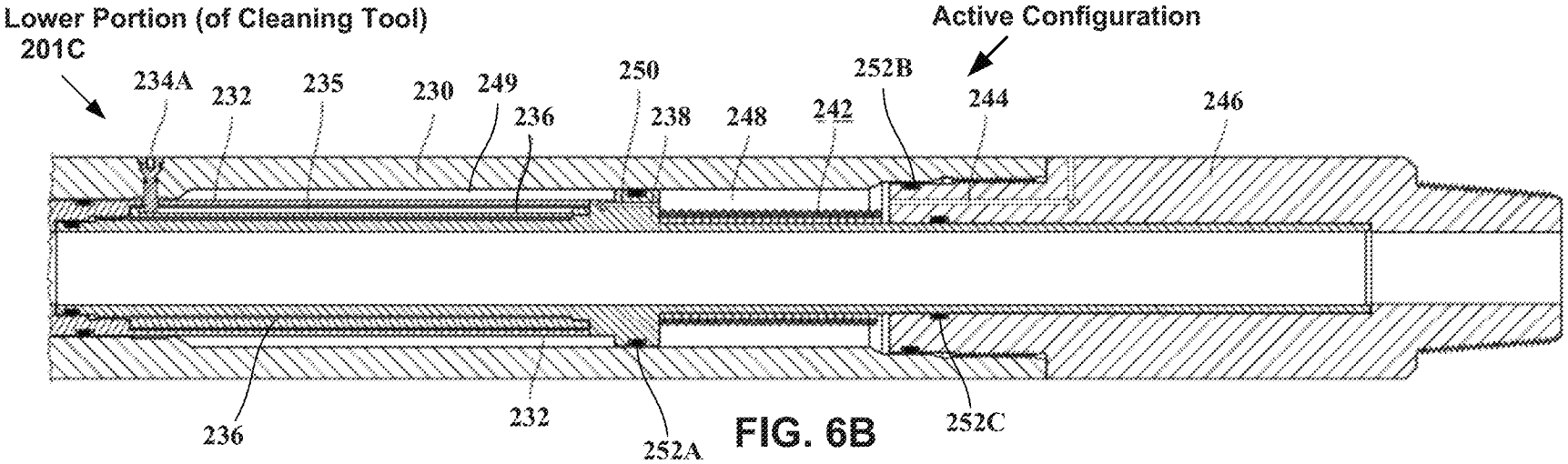

To help illustrate, FIGS. 6A-6B depict cross-sectional views of the lower portion of the example cleaning tool of FIG. 2 when the cleaning tool is in the inactive configuration and active configuration, respectively, according to some embodiments. In particular, FIG. 6A depicts an example of the lower portion 201C of the cleaning tool 200 of FIG. 2 when in an inactive configuration. The scraper mandrel 232 can be coupled to the lower inner mandrel 238. While depicted as a threaded connection, the scraper mandrel 232 and the lower inner mandrel 238 may be coupled using other means. In some embodiments, a portion of the lower inner mandrel 238 may extend into the lower adaptor 246. The J-slot sleeve 236 can be positioned between the lower inner mandrel 238 and the scraper mandrel 232 such that axial translation of the lower inner mandrel 238 and/or the scraper mandrel 232 moves the J-slot sleeve 236.

The shift pin 234A can extend through a wall of the lower tool body 230 and partially extend into a recess 235 of the J-slot sleeve 236. When the cleaning tool 200 is inactive, the shift pin 234A is in a first position (or inactive position) within the recess 235 of the J-slot sleeve 236 and the spring 242 is uncompressed. As the cleaning tool 200 activates and the scraper mandrel 232 and lower inner mandrel 238 translate axially to compress the spring 242, the shift pin 234A can move to a second position (or active position) within the recess 235 of the J-slot sleeve 236. FIG. 6B depicts the lower portion 201C of the cleaning tool 200 when the cleaning tool 200 is activated.

Referring to FIG. 6B, an example of the central portion 201B of the cleaning tool 200 of FIG. 2 is depicted when in the active configuration. FIG. 6B depicts the shift pin 234A in the second active position within the J-slot sleeve 236 and the spring 242 compressed. The lower inner mandrel 238 can move rightward and may partially extend into the lower adaptor 246. In some embodiments, the lower adaptor 246 can include a shoulder 253 to limit further axial translation of the lower inner mandrel 238.

Movement of the lower inner mandrel 238 rightward can cause an increase in fluid pressure within the oil chamber 248. In some embodiments, the lower adaptor 246 can include a pressure relief valve 244 to alleviate increased fluid pressure within the oil chamber 248. In some embodiments, fluid in the oil chamber 248 may be expelled into the annulus of the wellbore via the pressure relief valve 244. The cleaning tool 200 may also include a low flow check valve 250 in the lower inner mandrel 238 to prevent backflow of oil or other fluid within the oil chamber 248 into upper portions of the cleaning tool 200 when the cleaning tool 200 is inactive. Some fluid may also flow from the oil chamber 248 into an upper cavity 249 through the valve 250 to reduce the pressure in the oil chamber 248 as the lower inner mandrel 238 moves rightward to activate the cleaning tool 200.

In some embodiments, one or more O-rings can be positioned at interfaces between portions of the cleaning tool. FIG. 6B depicts an O-ring 252A positioned between the lower inner mandrel 238 and the lower tool body 230 to prevent a flow of fluid from the oil chamber 248 and/or pressure loss when the cleaning tool 200 is not activated. Optionally, O-rings may be positioned around the lower adaptor 246. FIG. 6B also depicts an O-ring 252B between the lower adaptor 246 and the lower tool body 230, and an O-ring 252C between the lower adaptor 246 and the lower inner mandrel 238. O-rings may be positioned at any location where there is risk of undesired fluid flow and/or pressure loss. For example, with reference to FIG. 2, O-rings can be positioned between the upper inner mandrel 208 and the upper adaptor 202, the scraper body 226 and the upper adaptor 202, the scraper mandrel 232 and the scraper body 226, the scraper body 226 and the lower tool body 230, the scraper mandrel 226 and the lower tool body 230, the scraper mandrel 232 and the lower inner mandrel 238, etc.

In some embodiments, movement of the shift pin 234A within the recess 235 can be controlled in order to activate the cleaning tool 200. Flowing a fluid through the cleaning tool 200 for a duration of time can move the shift pin 234A from the first position, where the cleaning tool 200 is inactive, to the second position, where the cleaning tool 200 is activated. A design of the J-slot sleeve can determine the duration of time required to activate the cleaning tool 200. In some embodiments, the recess 235 can prevent the cleaning tool 200 from activating when fluid is not flowed for the designated time durations.

Figure 7:
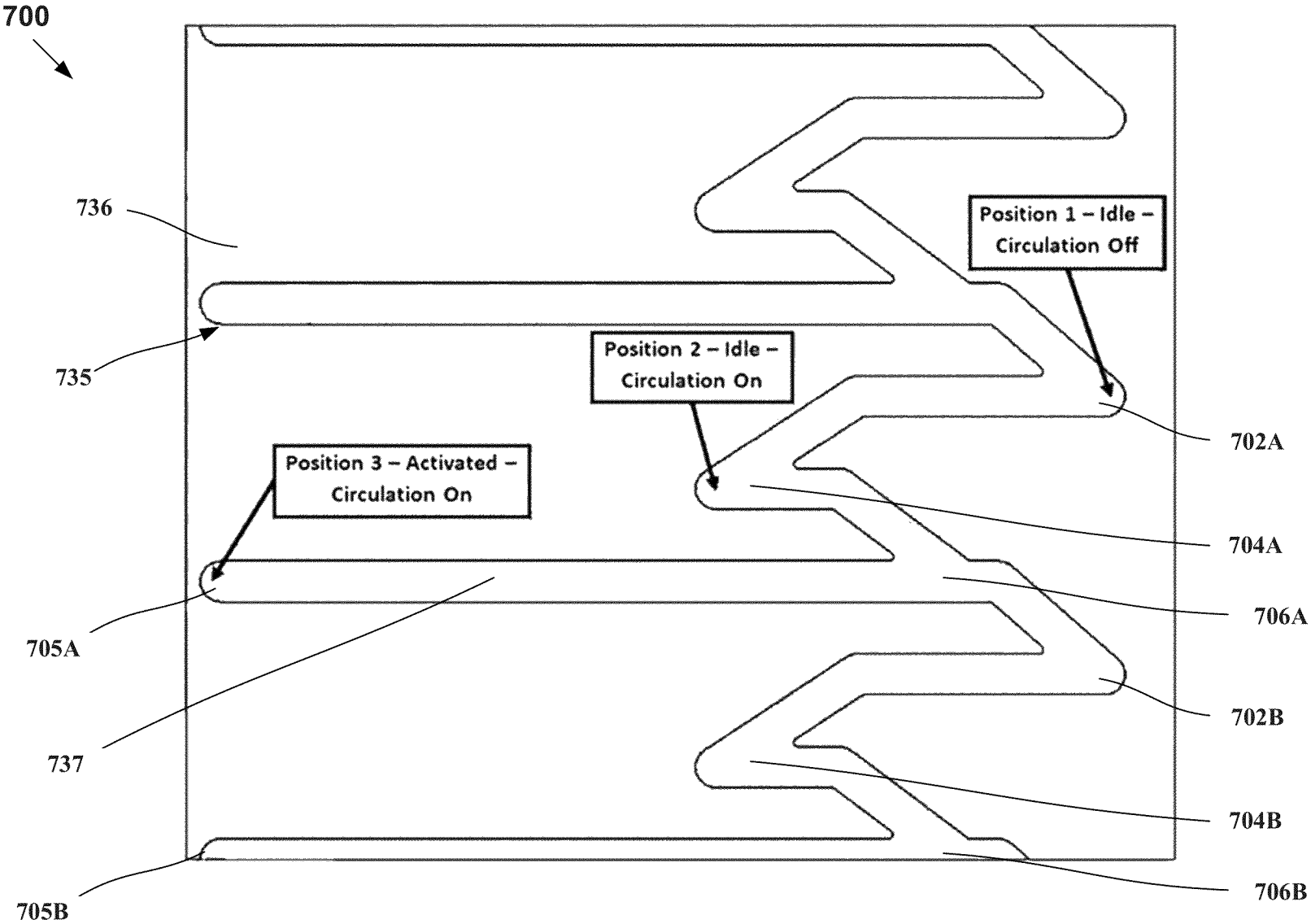
FIG. 7 depicts an example J-slot pattern, according to some embodiments.

To help illustrate, FIG. 7 depicts an example J-slot pattern, according to some embodiments. FIG. 7 depicts a 2D representation 700 of an example J-slot sleeve design that can be used as a pattern of a recess of the J-slot sleeve 236. An example recess 735 can be disposed an outer surface of the J-slot sleeve 236. A shift pin (the shift pin 234A, for example) can partially extend through the recess 735 and move positions within the recess 735 as the J-slot sleeve 236 rotates and translates axially about the shift pin.

When the cleaning tool 200 is inactive (i.e., scraper blades are not deployed and the cleaning tool 200 is in the inactive configuration as depicted in FIG. 2) and there is no flow of fluid through the cleaning tool 200, the shift pin is in a first idle position 702A. Once a flow of fluid begins circulating through the passage 205, a pressure differential between the inner passage 205 and the wellbore annulus is decreased by the flow of fluid. This decreased pressure differential allows for axial translation of the upper inner mandrel 208, the scraper mandrel 232, and the lower inner mandrel 238, which rotates and axially translates the J-slot sleeve 236 so that the shift pin is in a second idle position 704A after a first duration of time, $t_1$. Further rightward axial translation of the J-slot sleeve 236 (and lower inner mandrel 238, scraper mandrel 232, and upper inner mandrel 208) is inhibited as the shift pin 234A abuts the J-slot sleeve at the position 704A. The shift pin remains at the second idle position 704A while fluid continues to circulate through the cleaning tool 200.

When fluid circulation is stopped, the spring 242 biases the lower inner mandrel 238 (and in turn the scraper mandrel 232 and the upper inner mandrel 208) leftward (i.e. towards an uphole end of the cleaning tool 200). As the J-slot sleeve 236 moves leftward, the shift pin 234A causes the J-slot sleeve 236 to rotate about the shift pin 234A. If fluid circulation is not resumed as the shift pin 234A passes through an activation point 706A, the J-slot sleeve 236 can continue to move until the shift pin 234A is again at an idle position 702B. This can be repeated for multiple cycles as the J-slot sleeve 236 moves about the shift pin 234A and the shift pin 234A passes through a second set of positions (702B, 704B, and 706B).

In some embodiments, the cleaning tool 200 can be activated to deploy scraper blades by resuming fluid circulation after stopping fluid circulation for a second duration of time, $t_2$. The second duration of time can be the amount of time required for the shift pin 234A to reach the activation point 706A from the second idle position 704A. If fluid circulation is resumed at the time the shift pin 234A reaches the activation point 706A, the decrease in the pressure differential caused by the flow of fluid can move the upper inner mandrel 208, scraper mandrel 232, and lower inner mandrel 238 rightward to compress the spring 242 and activate the cleaning tool 200. When fluid circulation is resumed at this point, the J-slot sleeve 236 can axially translate further rightward (i.e., towards a downhole end of the cleaning tool 200), relative to the limit of axial translation when the shift pin 234A is at the position 704A, as a long axial slot 737 of the recess 735 slides along the shift pin 234A. The shift pin 234A can remain in an activated position 705A as long as circulation of fluid through the cleaning tool 200 continues.

The cleaning tool 200 can be de-activated by stopping fluid circulation, and the spring 242 can again bias the lower inner mandrel 238 (and in turn the scraper mandrel 232 and the upper inner mandrel 208) leftward (i.e. towards an uphole end of the cleaning tool 200) as the shift pin 234A travels to the position 702B. This can be repeated for multiple cycles as the J-slot sleeve 236 moves about the shift pin 234A and the shift pin 234A passes through a second set of positions (702B, 704B, 706B, and 705B).

In some embodiments, the J-slot sleeve 236 may be free floating, and the J-slot sleeve 236 may rotate relative to the scraper mandrel 232 and/or the lower inner mandrel 238 as the scraper mandrel 232 and the lower inner mandrel 238 translate axially. In some embodiments, the J-slot sleeve 236 can be substantially cylindrical and a pattern of the recess 235 can be a repeated pattern where the shift pin 234A moves through a similar series of positions with each cycle.

Figure 8:
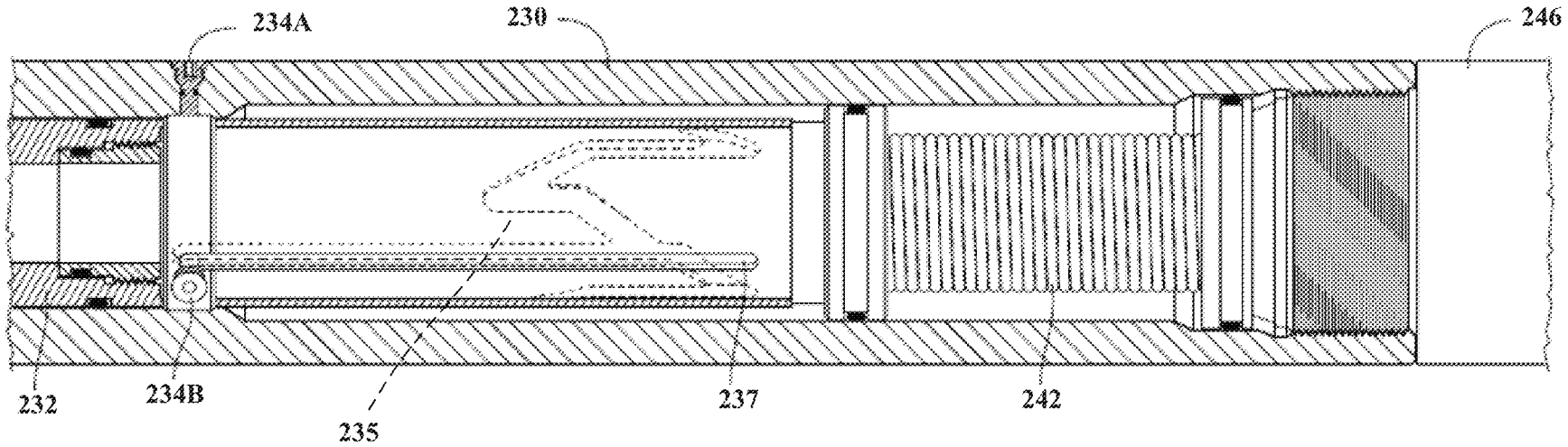
FIG. 8 depicts an additional view of an arrangement of a J-slot sleeve and a scraper mandrel when the cleaning tool is in the active configuration, according to some embodiments.

To help illustrate, FIG. 8 depicts an additional view of an arrangement of a J-slot sleeve and a scraper mandrel when the cleaning tool is in the deployed configuration, according to some embodiments. With reference to FIGS. 6B and 7, FIG. 8 depicts the shift pin 234A in the activated position 704A within the recess 235 of the J-slot sleeve 236 and a second shift pin 234B at a second activated position (e.g. 704B) within the recess 235. A slot 237 in the scraper mandrel 232 allows the lower inner mandrel 238, scraper mandrel 232, and the J-slot sleeve 236 to axially translate along the shift pins 234A and 235B. While two shift pins are depicted in FIG. 8, there may be a greater number or lesser number of shift pins.

Example Operations

Figure 9:
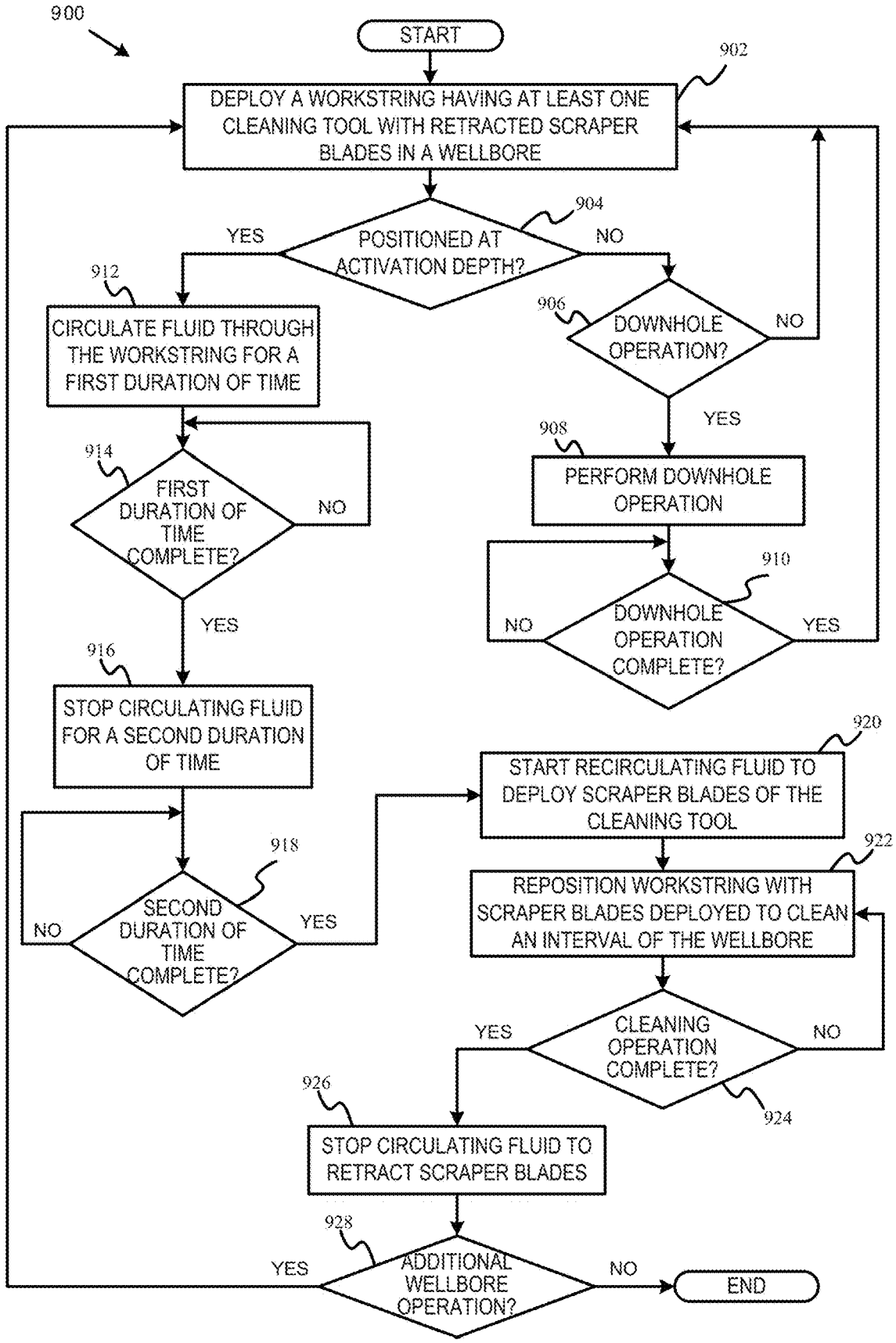
FIG. 9 depicts a flowchart of example operations for activating and deactivating a cleaning tool, according to some embodiments.

FIG. 9 depicts a flowchart of example operations for activating and deactivating a cleaning tool, according to some embodiments. In particular, FIG. 9 depicts a flowchart 900 of example operations for positioning, activating, and deactivating a cleaning tool of a workstring within a wellbore. Operations of the flowchart 900 can be performed by software, firmware, hardware, or a combination thereof. Operations of the flowchart 900 are described in reference to the example wellbore system 100 of FIG. 1 and the example downhole cleaning tool 200 of FIGS. 2, 3A-3B, 4A-4B, 6A-6B, and 7. However, other systems and components may be used to perform the operations now described. The operations of the flowchart 900 start at block 902.

At block 902, a workstring having at least one cleaning tool with retracted scraper blades is deployed within a wellbore. For example, with reference to FIG. 1, the workstring 104 having the downhole cleaning tool 110 can be deployed in the wellbore 102, where the scraper blades 114A, 114B, 114C, 115A, and 115B are retracted. As a second example, with reference to FIG. 2, the cleaning tool 200 can be deployed within the wellbore 102 while in the inactive configuration. In some embodiments, the workstring may be positioned in a completed wellbore. For example, with reference to FIG. 1, the workstring 104 can be positioned within the casing 108. Alternatively, the workstring may be positioned in an uncompleted wellbore.

Deploying the workstring in the wellbore can include one or both of performing a run-in-hole (RIH) and a pull-out-of-hole (POOH) operation. Performing a RIH operation can include moving the workstring downhole. For example, with reference to FIG. 1, a RIH operation can include lowering the workstring 104 within the wellbore 102 away from the surface 103. Performing a POOH operation can include moving the workstring uphole. For example, a POOH operation can include raising the workstring 104 within the wellbore 102 towards the surface 103.

At block 904, a determination is made of whether the cleaning tool of the workstring is deployed at an activation depth. The activation depth may be a depth within the wellbore at which the scraper blades of the cleaning tool are to be deployed. For example, with reference to FIG. 1, the activation depth may be a first depth within the wellbore 102 at which to begin a downhole cleaning operation. If the cleaning tool of the workstring is not positioned at the activation depth, operations of the flowchart 900 continue at block 906 to determine whether a downhole operation is to be performed. If the cleaning tool is positioned at the activation depth, operations of the flowchart 900 continue at block 912.

At block 906, a determination is made of whether to perform a downhole operation. For example, the downhole operation may be a washing operation to remove debris from an annulus of the wellbore. As a second example, the downhole operation may include a cementing operation. Alternatively or in addition, the downhole operation may be a measuring or logging operation. For example, the downhole operation can be a formation evaluation operation. If a downhole operation is to be performed, operations of the flowchart 900 continue at block 908. If a downhole operation is not to be performed, operations of the flowchart 900 continue at block 902.

At block 906, a downhole operation is performed. In some embodiments, downhole operation can be an operation requiring a circulation of fluid through the workstring. For example, the downhole operation may be a cementing operation and include circulating a cement slurry through the workstring. For example, the downhole operation can include circulating a cement slurry through the workstring 104 to cement the casing 108 within the wellbore 102. Alternatively or in addition, the downhole operation can include measuring or logging downhole data. For example, the downhole operation can include emitting and detecting acoustic waveforms to evaluate a formation property of the subterranean formation 109. The downhole operation can include other measurements, such as temperature measurements, pressure measurements, NMR and/or gamma-ray detection, etc.

At block 910, a determination is made of whether the downhole operation is complete. In some embodiments, the downhole operation is complete when downhole data collection is completed. For example, a formation evaluation operation may be complete when an amount of data is collected. Alternatively or in addition, the downhole operation may be complete after an amount of time. For example, a downhole operation including formation fluid sampling may be determined to be complete after a number of minutes has passed. In some embodiments, the downhole operation may be complete once a desired outcome has been achieved. For example, a cementing operation can be determined to be complete once an annulus between the casing 108 and the wellbore 102 is substantially filled with a cement slurry. If the downhole operation is complete, operations of the flowchart 900 continue at block 902 and the workstring is repositioned within the wellbore. Otherwise, operations of the flowchart 900 remain at block 910.

At block 912, a fluid is circulated through the workstring for a first duration of time. For example, with reference to FIG. 2, a washing fluid may be circulated through the passage 205 for a first duration of time. In some embodiments, the first duration of time can be determined by a pattern of the J-slot sleeve 236. For example, with reference to FIG. 7, the first duration of time may be a duration of time required to move the J-slot sleeve 236 about the shift pin 234A from the first idle position 702A to the second idle position 704A.

Prior to beginning fluid circulation through the workstring for the first duration of time, the cleaning tool of the workstring may be in an inactive configuration. For example, with reference to FIG. 2, the cleaning tool 200 may be in the inactive configuration prior to fluid circulation through the passage 205. With further reference to FIGS. 3A, 4A, and 6A, when the cleaning tool 200 is inactive, the piston 204 is unactuated, the magnets 216A and 216B are not aligned, the magnets 222A and 222B are not aligned, the internal bypass 206 is closed, the spring 242 is uncompressed, and the scraper blades 224A, 224B, 225A, and 225B are retracted. When fluid is circulating during the first duration of time, the spring 242 may be slightly compressed relative to when fluid is not circulating, but the magnets 216A and 216B are still not aligned, the magnets 222A and 222B are still not aligned, the internal bypass 206 is still closed, and the scraper blades 224A, 224B, 225A, and 225B are still retracted.

At block 914, a determination is made of whether the first duration of time is complete. In some embodiments, the determination of whether the first duration of time is complete can be made by software. If the first duration of time is not complete, operations of the flowchart 900 remain at block 914, where fluid circulation continues. If the first duration of time is complete, operations of the flowchart continue at block 916.

At block 916, the circulation of fluid is stopped for a second duration of time. In some embodiments, the second duration of time can be dependent on a pattern of the J-slot sleeve 236. For example, with reference to FIG. 7, the second duration of time may be a duration of time required to move the J-slot sleeve 236 about the shift pin 234A from the second idle position 704A to the activation point 706A.

When fluid circulation is stopped during the second duration of time, the tool may briefly return to the inactive configuration. For example, with reference to FIG. 2, the cleaning tool 200 may be in the inactive configuration when fluid circulation through the passage 205 is stopped. With further reference to FIGS. 3A, 4A, and 6A, when the cleaning tool 200 is inactive, the piston 204 is unactuated, the magnets 216A and 216B are not aligned, the magnets 222A and 222B are not aligned, the internal bypass 206 is closed, the spring 242 is uncompressed, and the scraper blades 224A, 224B, 225A, and 225B are retracted. In some embodiments, this intermittent fluid circulation can be controlled from a surface of the wellbore. For example, with reference to FIG. 1, operation of a pump (not pictured) can be controlled by a computer (not pictured) to start and/or stop fluid circulation through the workstring 104.

At block 918, a determination is made of whether the second duration of time is complete. In some embodiments, the determination of whether the second duration of time is complete can be made by software. If the second duration of time is not complete, operations of the flowchart 900 remain at block 918, where fluid circulation remains stopped. If the second duration of time is complete, operations of the flowchart continue at block 920.

At block 920, fluid circulation is restarted to deploy scraper blades of the cleaning tool. To activate the cleaning tool and deploy the scraper blades, fluid circulation can be resumed before the cleaning tool returns to an inactive position. For example, with reference to FIG. 7, fluid circulation can be resumed after the second duration of time is complete, but before the spring 242 biases the cleaning tool towards the inactive configuration and the shift pin 234A is positioned in the first idle position 702B.

In some embodiments, deploying the scraper blades can be controlled by a pattern of the J-slot sleeve 236. For example, with reference to FIG. 7, beginning fluid circulation after the second duration of time can move the J-slot sleeve 236 about the shift pin 234A from the activation point 706A to the activated position 705A. In some embodiments, the scraper blades can be deployed to be in contact with an inner surface of a casing of the wellbore. For example, with reference to FIG. 1, the scraper blades 114A, 114B, 114C, 115A, and 115B can be deployed to be in contact with the inner surface of the casing 108.

When fluid circulation is resumed, the cleaning tool can be activated. For example, with reference to FIG. 2, the cleaning tool 200 may be in the inactive configuration prior to resuming fluid circulation through the passage 205 after the second duration of time. When fluid circulation is resumed, a pressure differential between the inner passage 205 and the wellbore annulus (the annulus 111, for example) can allow for actuation of the piston 204 to activate the tool. With further reference to FIGS. 3B, 4B, and 6B, when the cleaning tool 200 is activated, the piston 204 is actuated, the magnets 216A and 216B are aligned, the magnets 222A and 222B are aligned, the internal bypass 206 is open, the spring 242 is compressed, and the scraper blades 224A, 224B, 225A, and 225B are deployed.

At block 922, the workstring is repositioned while having the scraper blades deployed to clean an interval of the wellbore. In some embodiments, repositioning the workstring in the wellbore can include moving the workstring downhole. For example, with reference to FIG. 1, repositioning the workstring 104 can include lowering the workstring 104 within the wellbore 102 away from the surface 103, where the scraper blades 114A, 114B, 114C, 115A, and 115B of deployed and the cleaning tool 110 is in an active configuration. Alternatively or in addition, repositioning the workstring can include moving the workstring uphole. For example, repositioning the workstring 104 can include raising the workstring 104 within the wellbore 102 towards the surface 103, where the scraper blades 114A, 114B, 114C, 115A, and 115B of deployed and the cleaning tool 110 is in an active configuration.

At block 924, a determination is made whether the cleaning operation is complete. The cleaning operation can be determined to be complete when the workstring has been moved a desired distance with the scraper blades deployed to clean an interval of the wellbore. For example, with reference to FIG. 1, the cleaning operation can be determined to be complete when the cleaning tool 110 (in the active configuration) has been moved 20 feet uphole with the scraper blades 114A, 114B, 114C, 115A, and 115B deployed to clean a 20 foot interval of the inner surface of the casing 108. The interval of the wellbore to be cleaned can be any interval of the wellbore. For example, the cleaning operation may be determined to be complete after cleaning a 5 foot interval, a 50 foot interval, a 100 foot interval, etc. of the wellbore 102. If the cleaning operation is incomplete, operations of the flowchart 900 continue at block 922 and the workstring is repositioned. If the cleaning operation is complete, operations of the flowchart 900 continue at block 926.

At block 926, fluid circulation is stopped and the scraper blades of the cleaning tool are retracted. In some embodiments, stopping fluid circulation returns the cleaning tool to an inactive configuration. For example, with reference to FIG. 2, stopping fluid circulation through the passage 205 can return the cleaning tool 200 to the inactive configuration where the scraper blades 224A and 224B are retracted. In some embodiments, stopping fluid circulation can result in an increased pressure differential and the cleaning tool can return to the inactive configuration. For example, with reference to FIG. 2, as fluid circulation is stopped and the pressure differential between the wellbore annulus and the passage 205 of the cleaning tool 200 is increased, the spring 242 may bias the lower inner mandrel 238 leftward to misalign the magnets 216A and 216B and the magnets 222A and 222B. Once the magnets are misaligned, the magnets 216B and 222B of the scraper blades 224A and 224B, respectively, may be attracted to the upper inner mandrel 208, retracting the scraper blades 224A and 224B.

At block 928, a determination is made whether any additional wellbore operations are to be performed. If an additional wellbore operation is to be performed, operations of the flowchart 900 continue at block 902. If there are no additional wellbore operations to be performed, operations of the flowchart 900 are complete.

FIG. 9 is annotated with a series of numbers 902-928. These numbers represent stages of operations. Although these stages are ordered for this example, the stages illustrate one example to aid in understanding this disclosure and should not be used to limit the claims. Subject matter falling within the scope of the claims can vary with respect to the order and some of the operations.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 922 and 908 can be performed in parallel or concurrently. For example, a downhole operation including downhole data collection may be performed while cleaning the interval of the wellbore. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Example Computer

Figure 10:
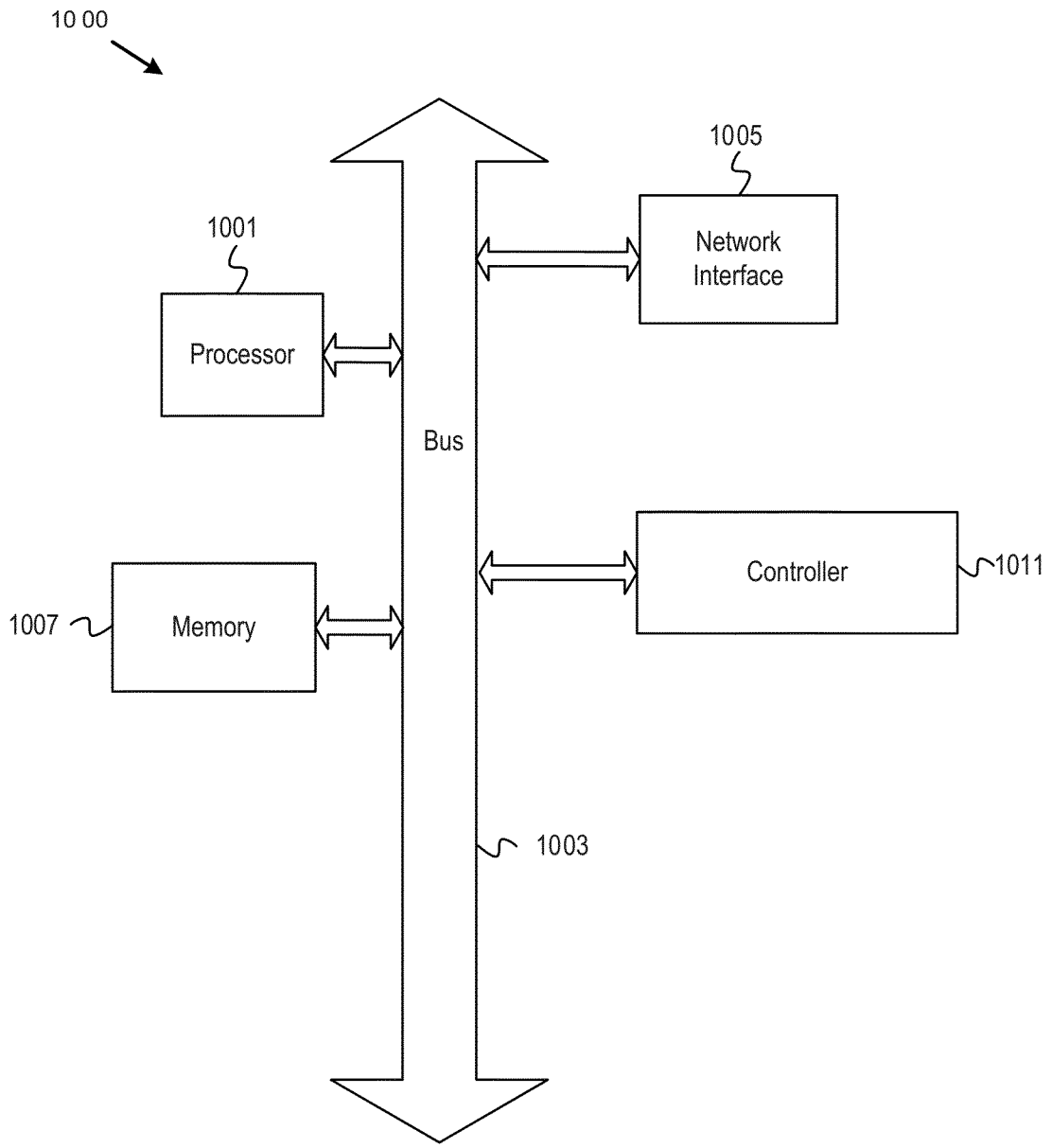
FIG. 10 depicts an example computer, according to some embodiments.

FIG. 10 depicts an example computer, according to some embodiments. A computer 1000 includes a processor 1001 (possibly including multiple processors, multiple cores, multiple nodes, and/or implementing multi-threading, etc.). The computer 1000 includes a memory 1007. The memory 1007 may be system memory or any one or more of the above already described possible realizations of machine-readable media. The computer 1000 also includes a bus 1003 and a network interface 1005.

The system also includes a controller 1011. The controller 1011 may perform one or more operations depicted in FIG. 9. Any one of the previously described functionalities may be partially (or entirely) implemented in hardware and/or on the processor 1001. For example, the functionality may be implemented with an application specific integrated circuit, in logic implemented in the processor 1001, in a co-processor on a peripheral device or card, etc. Further, realizations may include fewer or additional components not illustrated in FIG. 10 (e.g., video cards, audio cards, additional network interfaces, peripheral devices, etc.). The processor 1001 and the network interface 1005 are coupled to the bus 1003. Although illustrated as being coupled to the bus 1003, the memory 1007 may be coupled to the processor 1001.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Embodiment 1: A tool for cleaning a wellbore, the tool comprising: a tool body having a passage for a flow of liquid having an intermittent flow pattern; an inner sleeve positioned in the tool body and having a recess that includes a recess pattern; a shift pin to be positioned in the recess and to traverse through the recess pattern in response to the intermittent flow pattern of the flow of liquid; and at least one scraper blade that is movable between a retracted position and a radially expanded position outward toward a wall of the wellbore, in response to the shift pin traversing the recess pattern of the recess.

Embodiment 2: The tool of Embodiment 1, further comprising: a first magnet disposed on a surface of the at least one scraper blade; and a second magnet disposed on a surface of the inner sleeve, wherein the at least one scraper blade is to move from the retracted position to the radially expanded position outward to the wall of the wellbore based on relative movement of the first magnet to the second magnet.

Embodiment 3: The tool of Embodiment 2, wherein the inner sleeve is movable between a first position and a second position as the shift pin traverses the recess pattern of the recess, wherein, in the first position, the first magnet and the second magnet are offset, and wherein, in the second position, the first magnet and the second magnet are substantially aligned.

Embodiment 4: The tool of Embodiment 3, wherein the at least one scraper blade is to retract in response to the first magnet and the second magnet being offset, and wherein the at least one scraper blade is to deploy outward to the radially expanded position, in response to the first magnet and the second magnet being substantially aligned.

Embodiment 5: The tool of any one of Embodiments 1-4, wherein the at least one scraper blade is to be in the retracted position while the tool is deployed to a cleaning depth in the wellbore where the wellbore is to be cleaned, and wherein, in response to the tool being positioned at the cleaning depth, the at least one scraper blade to move from the retracted position to the radially expanded position, in response to the shift pin traversing the recess pattern of the recess.

Embodiment 6: The tool of Embodiment 5, wherein the at least one scraper blade is to move from the radially expanded position back to the retracted position, after at least a portion of the wellbore has been cleaned with the at least one scraper blade and while the tool is positioned in the wellbore.

Embodiment 7: A method comprising: deploying, into a wellbore, a cleaning tool having at least one scraper blade in a retracted position; and in response to the cleaning tool being positioned at a cleaning depth in the wellbore, moving the at least one scraper blade from the retracted position to a radially expanded position outward toward a wall of the wellbore, in response to an intermittent flow pattern of a flow of liquid passing through a passage in the cleaning tool.

Embodiment 8: The method of Embodiment 7, wherein the cleaning tool includes an inner sleeve positioned in a tool body of the cleaning tool and having a recess that includes a recess pattern into which a shift pin is positioned, and wherein moving the at least one scraper blade from the retracted position to the radially expanded position outward toward the wall of the wellbore comprises moving the at least one scraper blade from the retracted position to the radially expanded position outward toward the wall of the wellbore in response to the shift pin moving through the recess pattern based on the intermittent flow pattern.

Embodiment 9: The method of Embodiment 8, wherein the cleaning tool comprises a first magnet disposed on a surface of the at least one scraper blade and a second magnet disposed on a surface of the inner sleeve, and wherein moving the at least one scraper blade from the retracted position to the radially expanded position outward toward the wall of the wellbore comprises moving the at least one scraper blade from the retracted position to the radially expanded position outward toward the wall of the wellbore in response relative movement of the first magnet to the second magnet.

Embodiment 10: The method of Embodiment 9, wherein moving the at least one scraper blade from the retracted position to the radially expanded position outward toward the wall of the wellbore comprises moving the at least one scraper blade from the retracted position to the radially expanded position outward toward the wall of the wellbore in response the first magnet and the second magnet being substantially aligned.

Embodiment 11: The method of Embodiment 10, further comprising: moving the at least one scraper blade from the radially expanded position back to the retracted position, after cleaning at least a portion of the wellbore and while the cleaning tool is positioned in the wellbore.

Embodiment 12: The method of Embodiment 11, wherein moving the at least one scraper blade from the radially expanded position back to the retracted position comprises moving the at least one scraper blade from the radially expanded position back to the retracted position in response to the first magnet and the second magnet being offset relative to each other.

Embodiment 13: A system comprising: a workstring to be deployed in a wellbore, the workstring having a cleaning tool that comprises, a tool body; at least one scraper blade disposed on an outer surface of the tool body; a first magnet disposed on a first surfaces of the cleaning tool; and a second magnet disposed on a second surface of the cleaning tool, wherein the at least one scraper blade is to move from a retracted position to a radially expanded position outward to a wall of the wellbore based on relative movement of the first magnet to the second magnet.

Embodiment 14: The system of Embodiment 13, further comprising: an inner sleeve positioned in the tool body, wherein the first magnet is disposed on a surface of the at least one scraper blade and the second magnet is disposed on a surface of the inner sleeve.

Embodiment 15: The system of Embodiment 14, wherein the inner sleeve is movable between a first position and a second position, wherein, in the first position, the first magnet and the second magnet are offset, and wherein, in the second position, the first magnet and the second magnet are substantially aligned.

Embodiment 16: The system of Embodiment 15, wherein the at least one scraper blade is to retract in response to the first magnet and the second magnet being offset.

Embodiment 17: The system of Embodiment 16, wherein the at least one scraper blade is to deploy outward to the radially expanded position, in response to the first magnet and the second magnet being substantially aligned.

Embodiment 18: The system of Embodiment 17, wherein further comprising: a shift pin positioned at least partially within a recess disposed on the outer surface of the inner sleeve, wherein the shift pin is movable between the first position and the second position.

Embodiment 19: The system of Embodiment 18, wherein the recess disposed on the outer surface of the inner sleeve has a pattern, and wherein the shift pin is movable through the pattern of the outer surface based on a flow of a liquid through a passage in the cleaning tool.

Embodiment 20: The system of Embodiment 18, wherein the recess disposed on the outer surface of the inner sleeve has a pattern, and wherein the shift pin is movable through the pattern of the outer surface based on an intermittent flow of a liquid through a passage in the cleaning tool that is based on the pattern.

What is claimed is:

1. A system comprising:

a workstring to be deployed in a wellbore, the workstring having a cleaning tool that comprises, a tool body having an upper inner mandrel, a scraper body, a bypass opening and a flow path for a flow of liquid through the tool body;

at least one scraper blade positioned on the scraper body;

a first magnet disposed on a first surface of the cleaning tool; and a second magnet disposed on a second surface of the cleaning tool, wherein the at least one scraper blade is configured to move from a retracted position to a radially expanded position outward to a wall of the wellbore based on movement of the first magnet relative to the second magnet, wherein the upper inner mandrel includes an internal bypass positioned uphole of the scraper body, wherein the bypass opening and the internal bypass align when the at least one scraper blade is in the radially expanded position, enabling fluid flow between the wellbore annulus and the flow path uphole of the at least one scraper blade.

2. The system of claim 1, wherein the first magnet is disposed on a surface of the at least one scraper blade and the second magnet is disposed on a surface of the upper inner mandrel.

3. The system of claim 2, wherein the cleaning tool further comprises an inner sleeve movable between a first position and a second position, wherein, in the first position, the first magnet and the second magnet are offset, and wherein, in the second position, the first magnet and the second magnet are substantially aligned.

4. The system of claim 3, wherein the at least one scraper blade is configured to retract in response to the first magnet and the second magnet being offset.

5. The system of claim 4, wherein the at least one scraper blade is configured to deploy outward to the radially expanded position, in response to the first magnet and the second magnet being substantially aligned.

6. The system of claim 5, further comprising:

a shift pin, the shift pin extending at least partially into a recess pattern disposed on a surface of the inner sleeve, wherein the inner sleeve movements between the first position and the second position are limited by movement of the shift pin within the recess.

7. The system of claim 6, wherein the shift pin is movable through the recess pattern based on a flow of a liquid through the flow path.

8. The system of claim 6, wherein the shift pin is movable through the recess pattern based on an intermittent flow of a liquid through the flow path, the intermittent flow based on the recess pattern.

9. A method comprising:

deploying a workstring into a wellbore, the workstring including a cleaning tool disposed thereon, the cleaning tool comprising:

a tool body having an upper inner mandrel, a scraper body, a bypass opening and a flow path for a flow of liquid through the tool body;

at least one scraper blade positioned on the scraper body;

a first magnet disposed on a first surface of the cleaning tool; and a second magnet disposed on a second surface of the cleaning tool, wherein the at least one scraper blade is deployed in a retracted position and configured to move from the retracted position to a radially expanded position outward to a wall of the wellbore based on movement of the first magnet relative to the second magnet, wherein the upper inner mandrel includes an internal bypass positioned uphole of the scraper body, wherein the bypass opening and the internal bypass align when the at least one scraper blade is in the radially expanded position, enabling fluid flow between the wellbore annulus and the flow path uphole of the at least one scraper blade;

positioning the cleaning tool at a cleaning depth; and in response to the workstring being positioned at a cleaning depth, controlling a flow of liquid through the flow path; and moving the at least one scraper blade from the retracted position to a radially expanded position in response to controlling the flow of liquid through the flow path of the cleaning tool.

10. The method of claim 9, wherein the flow of liquid through the flow path has an intermittent flow pattern.

11. The method of claim 9, wherein the cleaning tool further includes a shift pin and an inner sleeve positioned in the tool body of the cleaning tool, the inner sleeve having a recess that includes a recess pattern into which the shift pin is positioned, and wherein moving the at least one scraper blade from the retracted position to the radially expanded position outward toward the wall of the wellbore comprises moving the at least one scraper blade from the retracted position to the radially expanded position outward toward the wall of the wellbore in response to the shift pin moving through the recess pattern based an intermittent flow pattern of liquid through the flow path.

12. The method of claim 9, wherein the first magnet is disposed on a surface of the at least one scraper blade, wherein the second magnet is disposed on a surface of the upper inner mandrel, and wherein moving the at least one scraper blade from the retracted position to the radially expanded position outward toward the wall of the wellbore comprises moving the upper inner mandrel axially relative to the at least one scraper blade.

13. The method of claim 12, wherein moving the at least one scraper blade from the retracted position to the radially expanded position outward toward the wall of the wellbore comprises substantially aligning the first magnet with the second magnet.

14. The method of claim 13, further comprising:

moving the at least one scraper blade from the radially expanded position back to the retracted position, after cleaning at least a portion of the wellbore and while the workstring is positioned in the wellbore.

15. The method of claim 14, wherein moving the at least one scraper blade from the radially expanded position back to the retracted position comprises moving the first magnet and the second magnet substantially offset to each other.

* * * * *